US005151709A

United States Patent [19]

Balzano et al.

[11] Patent Number: 5,151,709

[45] Date of Patent: Sep. 29, 1992

[54] TUNABLE SUPERCONDUCTIVE ANTENNA

[75] Inventors: Quirino Balzano, Plantation; Robert E. Stengel, Ft. Lauderdale, both of Fla.

[73] Assignee: Motorola, Inc., Schaumburg, Ill.

[21] Appl. No.: 419,551

[22] Filed: Oct. 10, 1989

[51] Int. Cl.[5] ..... H01Q 7/00; H01Q 5/010

[52] U.S. Cl. ..... 343/741; 343/744; 343/868

[58] Field of Search ..... 505/1, 700, 701; 343/741, 742, 866, 867, 702, 718, 744, 743, 868

[56] References Cited

U.S. PATENT DOCUMENTS 1,554,328 9/1925 Brenner ..... 343/866

4,869,598 9/1989 McDonald ..... 307/306

OTHER PUBLICATIONS 01-17503, Plane Antenna, Yamamoto et al., Japanese Application Publication Jan. 20, 1989.

*Primary Examiner*—Michael C. Wimer
*Assistant Examiner*—Peter Toby Brown
*Attorney, Agent, or Firm*—Michael J. Buchenhorner

[57] ABSTRACT

An antenna (10) capable of receiving signals of various frequencies includes a series of superconducting antenna segments and decouplers disposed between each adjacent pair of antenna segments for selectively decoupling at least one antenna segment from the antenna (10) in response to the frequency of the signal received.

8 Claims, 1 Drawing Sheet

TUNABLE SUPERCONDUCTIVE ANTENNA

TECHNICAL FIELD

This invention relates generally to antennas, and more specifically to superconductive antennas.

BACKGROUND

The magnetic properties of loop antennas make such antennas useful for radio receivers to be used on or near the human body (e.g. pagers). The bandwidth of loop antennas offers selectivity to received-signal frequencies, but has the drawback of limited received-frequency range without tuning or adjustment. Varactors and saturated core inductors are commonly used electronically-tuned elements; both exhibit nonlinear behavior. The drawback of using those elements is degraded receiver distortion rejection. The use of loop antennas has thus been confined to narrow-frequency range applications or for use in conjunction with mechanical tuning.

SUMMARY OF THE INVENTION

Accordingly, it is an object of the present invention to provide an antenna that avoids the detriments of the prior art.

Briefly, according to the invention, an antenna capable of receiving signals of various frequencies comprises a plurality of superconducting antenna segments and decoupling means for selectively decoupling at least one antenna segment from the antenna in response to the frequency of the signal received.

BRIEF DESCRIPTION OF THE FIGURE

The FIGURE shows a superconducting antenna in accordance with the present invention.

DETAILED DESCRIPTION OF THE PREFERRED EMBODIMENT

Figure 1:
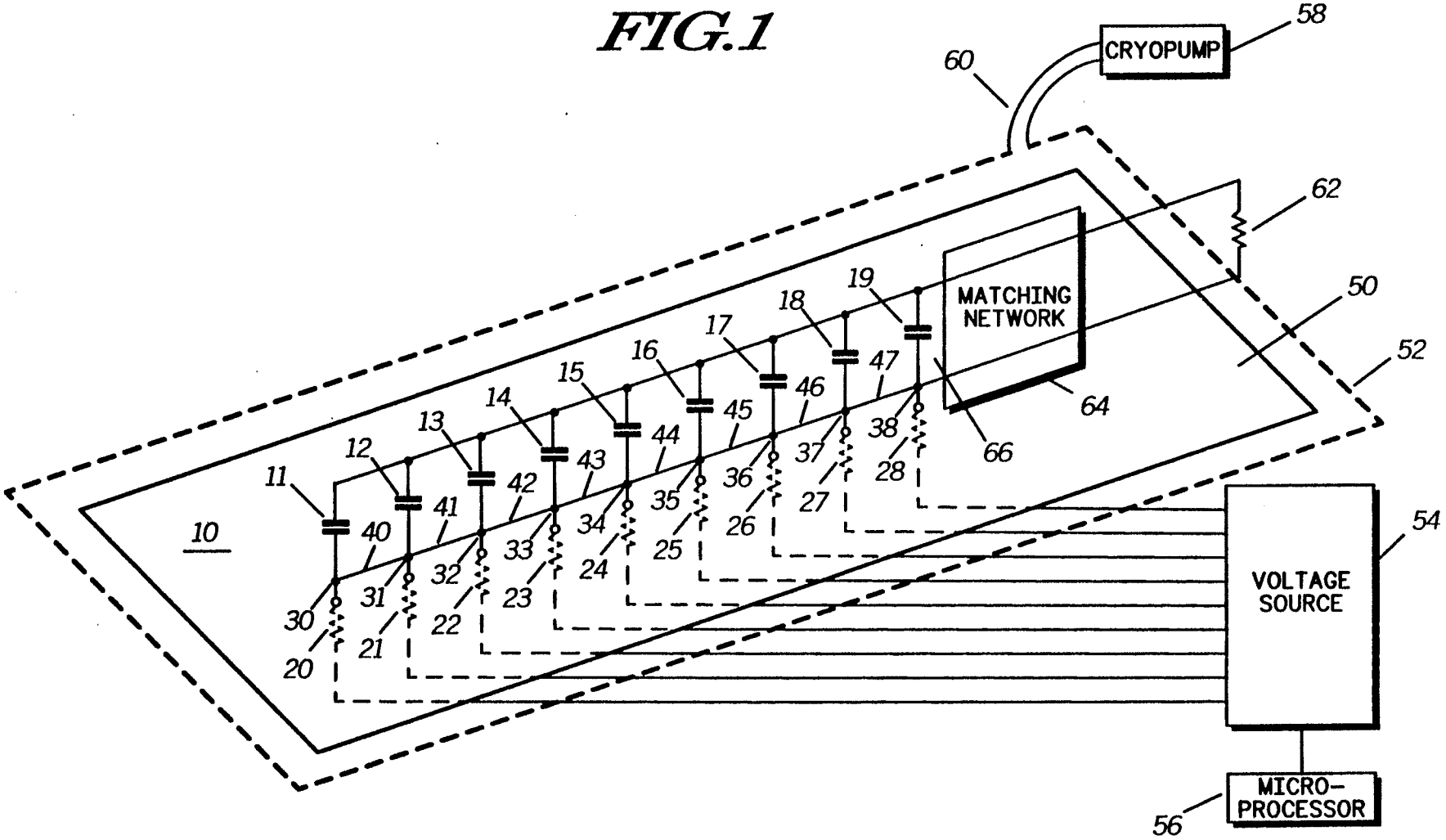

Referring to the FIGURE, a superconductive lattice loop antenna 10 in accordance with the invention is shown. In the preferred embodiment, the lattice antenna 10 includes a loop 66 of superconductive material (e.g., a superconductive thin film over a substrate) located above a superconductive ground plane 50. The ground plane 50 may be as large as the mechanical packaging constraints will allow. The loop antenna 10 is subdivided into a lattice of subloops. Each subloop includes a capacitor and a transverse segment. The selectivity of the antenna 10 is adjusted by properly decoupling subloops from the loop 66. At the lowest frequency of operation, the antenna 10 uses all of its subloops and thus has its largest area. For operation at higher frequencies, the lattice antenna's (10) size is reduced by decoupling a number of subloops, depending on the frequency selected.

The lattice antenna 10 includes capacitors 11–19, coupled together, so that eight subloops are formed. A set of resistors, 20–28 each have one terminal coupled to a terminal of one of the capacitors, at a series of nodes 30–38. A series of transverse segments 40–47 are each disposed between a pair these nodes. Each of the resistors provides a direct-current (DC) path from a voltage source 54 (having multiple outputs) to a transverse segment, thus completing a series of DC loops that are used to control the area of the loop 66. The voltage source 54 is controlled by a microprocessor 56 slave to the receiver frequency. Thus, the microprocessor activates certain outputs depending on the frequency of the received signal. The values of these resistors are chosen to be large enough to isolate the voltage source 54 from the radio-frequency (RF) properties of the antenna 10 and to minimize losses.

A resistor 62 represents the load of the lattice antenna 10. A matching network 64 may be introduced between the resistor 62 and the loop 66 to match the impedance of the resistor 62. A cryopump 58 (or other refrigeration means) may be used to cool the materials of the loop 66 or of the substrate 50, if required. A containing means 52 (shown by broken lines) may also be used to contain the refrigerated area. The cryopump 58 pumps refrigerant to the refrigerated area through a line 60.

The microprocessor 56 detects the frequency of the received signal and then, as a function of that frequency, selects two outputs of the voltage source 54 to provide voltage across the output terminals coupled to the pair of resistors that are both coupled to the transverse segment that must be driven out of superconductivity in order to decouple a selected set of subloops from the loop 66. For example, if the highest operating frequency of the lattice antenna 10 is received, the microprocessor 56 applies a voltage between the outputs of the voltage source 54 that are coupled to the resistors 27 and 28. The values of the resistors 27 and 28 are chosen so that at the voltage provided by the voltage source 54 each resistor conducts sufficient DC current to drive the superconductive segment 47 out of its superconductive state: Thus, when the segment 47 is not superconductive, it approximates an open switch, decoupling the portion of the loop 66 comprising capacitors 11–18. The value of the capacitor 19 is selected so that the loop operating at the highest frequency resonates at that frequency.

As another example, if the received signal has the lowest frequency of the lattice antenna 10, the microprocessor 56 does not cause the voltage source 54 to apply a voltage across any of its output terminals, thus leaving each of those in a high impedance state and the entire loop 66 is used. The values of the capacitors 11–19 are chosen such that their parallel combination resonates at the lowest operating frequency of the antenna.

As a final example, if the frequency of the received signal lies between the highest and the lowest operating frequencies of the lattice antenna 10 and the capacitors 17–19 resonate in parallel at that frequency, the microprocessor 56 causes the voltage source 54 to apply a voltage across any of its output terminals that are connected to the resistors that are both connected to a transverse segment that will decouple the subloops containing the capacitors 11–16 when it is driven out of superconductivity.

Therefore, the antenna 10 utilizes the properties of superconducting materials to vary the effective area of the loop 66 for improving the selectivity of the lattice antenna 10 over a range of frequencies. Although the embodiment of the present invention just described relates to loop antennas, persons skilled in the art will appreciate that the invention may be used in other antenna configurations.

What is claimed is:

1. An antenna, for receiving signals, each signal having a frequency, comprising:

a plurality of superconducting antenna segments;

decoupling means for selectively decoupling at least one antenna segment from the antenna in response to the frequency of the signal received; and a plurality of superconducting transverse segments, each transverse segment being for coupling an antenna segment to an adjacent antenna segment when the transverse segment is in a superconducting state, and for decoupling the antenna segment from the adjacent antenna segment, when the transverse segment is not in a superconducting state.

2. The antenna of claim 1, further comprising means for providing a DC current, having a selected level, to a selected superconducting transverse segment for driving the selected superconducting transverse segment out of a superconducting state.

3. The antenna of claim 2, wherein each superconducting antenna segment comprises a capacitor.

4. A loop antenna for receiving signals, each signal having a frequency, comprising:

a plurality of subloops;

decoupling means for selectively decoupling at least one subloop from the loop antenna in response to the frequency of the signal received; and a plurality of superconducting transverse segments, each transverse segment being for coupling a subloop to an adjacent subloop when the transverse segment is in a superconducting state and for decoupling the subloop from the adjacent subloop when the transverse segment is not in a superconducting state.

5. The loop antenna of claim 4, wherein each subloop comprises a capacitor.

6. The loop antenna of claim 4, further comprising:

means for providing a selected level of DC current to a selected superconducting transverse segment for driving the selected superconducting transverse segment out of a superconducting state and thus decoupling at least one subloop from the loop antenna.

7. The loop antenna of claim 6, further comprising a plurality of resistors, each resistor coupled to a superconducting transverse segment for providing a selected level of DC current in response to a selected voltage applied to a terminal of the resistor.

8. The loop antenna of claim 6, further comprising means for providing the selected voltage as a function of the frequency of the signal received by the loop antenna.

* * * * *